United States Patent [19]

Frank et al.

[11] 4,229,521

[45] Oct. 21, 1980

[54] METHOD OF PROCESSING PHOTOGRAPHIC MATERIALS

[75] Inventors: Karl Frank, Leverkusen; Hans-Dieter Block, Cologne, both of Fed. Rep. of Germany

[73] Assignee: AGFA-Gevaert, A.G., Fed. Rep. of Germany

[21] Appl. No.: 923,675

[22] Filed: Jul. 11, 1978

[30] Foreign Application Priority Data

Jul. 15, 1977 [DE] Fed. Rep. of Germany ..... 2732153

[51] Int. Cl.[2] ..... G03C 5/32; G03C 7/00

[52] U.S. Cl. ..... 430/372; 430/427

[58] Field of Search ..... 96/60 BF, 22, 60 R, 96/56; 430/372, 427

[56] References Cited

U.S. PATENT DOCUMENTS 3,997,348 12/1976 Shimamura et al. ..... 96/60 BF

*Primary Examiner*—Mary F. Downey

*Attorney, Agent, or Firm*—Connolly & Hutz

[57] ABSTRACT

A new bath composition for processing photographic materials with at least one silver halide layer is provided in which discolorations caused by Fe III-bleaching agents are prevented by an after-treatment bath comprising phosphoric acid or a phosphonic acid as hereinafter described.

6 Claims, No Drawings

METHOD OF PROCESSING PHOTOGRAPHIC MATERIALS

This invention relates to a process for bleaching and after-treatment photographic materials which contain silver, in particular materials in which dyes have been produced by chromogenic development.

When processing the usual colour photographic materials which contain silver halide, a silver image is produced in addition to the dye image, but this silver image must be removed before processing is completed. As is known, oxidizing bleaching baths are used for this purpose. The bleaching agents used in these baths are generally iron-III cyanides, iron-III-aminopolycarboxylic acid complex salts or iron-III salts of the type described in German Offenlegungsschrift No. 2,433,695.

Although bleaching baths which contain iron-III cyanides are capable of bleaching photographic materials as required, baths which contain cyanides are preferably avoided. The iron-III complex of ethylene diamiotetracetic acid which has been proposed as a bleaching agent may be used as bleaching agent in the presence of bromide ions but acts too slowly in neutral solution. If a bath containing the iron-III complex of ethylene diaminotetracetic acid is acidified, the bleaching process is considerably accelerated but the image dyes, particularly the cyan dyes of the indophenol type are attacked in the acid medium. The use of non-complex iron-III compounds as bleaching agents, for example iron-III chloride, causes severe discolouration of the photographic material, particular in layers which contain gelatine. The measures hitherto proposed for preventing such discolouration do not provide a satisfactory solution. The addition of certain organic carboxylic acids according to German Offenlegungsschrift No. 2,431,481 directly to the bleaching baths does not sufficiently prevent the discolouration of the photographic materials. In German Offenlegungsschrift No. 2,433,695, it is proposed to treat the bleached material with certain organic phosphonic acids in an after-treatment bath. These phosphonic acids are difficultly soluble in acid solutions and form precipitates with iron-III ions in the treatment baths without destroying the discolouration of gelatine while in neutral or slightly alkaline solutions they are virtually ineffective. The use of the organic carboxylic acids mentioned in German Offenlegungsschrift No. 2,433,695 in the after-treatment bath also fails satisfactorily to eliminate the discolourations of the photographic material.

It is an object of the present invention to provide a method of processing photographic materials in which the discolourations mentioned above are reduced or substantially prevented and the disadvantages of the known methods substantially avoided.

It has now been found that the problems mentioned above can be reduced or substantially solved by bleaching the colour photographic materials with a bleaching solution containing an iron-III salt and treating the material with an acid-containing after-treatment bath which contains, as acid, phosphoric acid or a phosphonic acid in which the organic residue is substituted with at least one carboxyl group. The organic residue may be an alkyl residue and may in addition be substituted with water solubilizing groups such as $PO_3H_2$, $SO_3H$, OH or an alkylene oxide group. Preferred acids are those corresponding to the following general formula;

$$A—PO_3H_2$$

in which

A represents a hydroxyl group or an alkyl group having from 1 to 6 carbon atoms which is substituted with at least one carboxyl group and may in addition be substituted with water solubilizing groups such as $PO_3H_2$, $SO_3H$, OH or an alkylene oxide group.

The bleaching agents used in the bleaching bath are preferably iron-III sulphate and particularly iron-III chloride, and they are preferably used in a quantity of from 50 to 250 g per liter, in particular from 100 to 150 g per liter. According to a preferred embodiment of the invention, the bleaching solution in addition contains ammonium halides or alkali metal halides, in particular the bromides, in a quantity of from 10 to 50 g per liter. The pH of the bleaching solution is preferably in the highly acid range, particularly less than pH 3 and may be adjusted with suitable acids, for example with the acids used in the after-treatment bath according to the invntion.

The acids to be used according to the invention are generally added to the after-treatment bath in a quantity of from 1 to 200 g, in particular from 50 to 150 g per liter, preferably in a strongly acid medium. The following are examples of suitable acids: 2-phosphonosuccinic acid; 2-methyl-2-phosphonosuccinic acid; 2,4-diphosphonobutane-1,2-dicarboxylic acid and, particularly, 2-phosphonobutane-1,2,4-tricarboxylic acid and phosphoric acid.

The method of preparation of the acids to be used according to the invention has been described, for example, in German Offenlegungsschrift No. 2,015,068.

The process according to the invention may be applied to the treatment of a light-sensitive photographic material which contains couplers. These compounds may be the usual colour couplers which are generally incorporated directly in the silver halide layers. Thus, the red sensitive layer, for example, contains a non-diffusible colour coupler for the production of the cyan partial colour image, generally a phenol or $\alpha$-naphthol coupler. The green sensitive layer may contain at least one non-diffusible colour coupler for the production of the magenta partial colour image, usually a 5-pyrazolone or indazolone coupler. Lastly, the blue sensitive layer unit may contain at least one nondiffusible colour coupler for the production of the yellow partial colour image, generally a colour coupler containing an open chain ketomethylene group. Large numbers of such colour couplers are known and have been described in numerous Patent Specifications.

Reference may be made, for example, to the publication "Farbkuppler" by W. Pelz in "Mitteilungen aus den Forschungslaboratorien der Agfa, Leverkusen Munchen", Volume III (1961) and K. Venkataraman in "The Chemistry of Synthetic Dyes", Volume 4, 341–387, Academic Press (1971).

The non-diffusible colour couplers used may be 2-equivalent couplers. These contain a removable substituent in the coupling position so that they only require two equivalents of silver halide to form the dye, in contrast to the usual 4-equivalent couplers. Suitable 2-equivalent couplers include, for example, the known DIR couplers in which the removable group is released as diffusible development inhibitor after the reaction with the colour developer oxidation products. So-called while couplers may also be used for improving the properties of the photographic material.

The non-diffusible colour couplers and colour producing compounds are added to the light sensitive silver halide emulsions or other casting solutions by the usual known methods. If the compounds are soluble in water or alkalis, they may be added to the emulsions in the form of aqueous solutions, in which water miscible organic solvents such as ethanol, acetone or dimethylformamide may be added. If, on the other hand, the non-diffusible colour couplers and colour producing compounds are insoluble in water or alkalis, they may be emulsified in known manner, e.g. by mixing a solution of these compounds in a low boiling organic solvent either directly with the silver halide emulsion or first with an aqueous gelatine solution and then removing the organic solvent in the usual manner. The resulting emulsion of the given compound in gelatine is subsequently mixed with the silver halide emulsion.

The emulsification of such hydrophobic compounds may be assisted by means of so-called coupler solvents or oil formers. These are generally relative high boiling organic compounds in which the non-diffusible colour couplers and development inhibitor releasing compounds which are required to be emulsified in the silver halide emulsions become enclosed in the form of oily droplets. Reference may be made in this connection to, for example, U.S. Pat. Nos. 2,322,027; 2,533,514; 3,689,271; 3,764,336 and 3,765,897.

The usual silver halide emulsions are suitable for the present invention. The silver halide contained in them may be silver chloride, silver bromide, silver iodide or mixtures thereof.

The usual colour developer substances may be used, for example the following:

N,N-dimethyl-p-phenylenediamine;
4-amino-3-methyl-N-ethyl-N-methoxyethylaniline;
2-amino-5-diethylaminotoluene;
N-butyl-N-ω-sulphobutyl-p-phenylenediamine;
2-amino-5-(N-ethyl-N-β-methanesulphonomidoethylamino)-toluene;
N-ethyl-N-β-hydroxyethyl-p-phenylenediamine;
N,N-bis-(β-hydroxyethyl)-p-phenylenediamine and
2-amino-5-(N-ethyl-N-βhydroxyethylamino)-toluene.

The binder used for the photographic layers is preferably gelatine but this may be partly or completely replaced. Suitable natural binders include, for example, alginic acid and its derivatives such as its salts, esters or amides; cellulose derivatives such as carboxymethylcellulose or alkylcelluloses such as hydroxyethylcellulose; starch or its derivatives such as its ethers or esters, or carrageenates. Polyvinyl alcohol, partially saponified polyvinyl acetate, and polyvinyl pyrrolidone are suitable synthetic binders.

The emulsions may also be chemically sensitized, e.g. by the addition, at the chemical ripening stage of sulphur compounds such as allylisothiocyanate, allylthiourea and sodium thiosulphate. Reducing agents, e.g. the tin compounds described in Belgian Pat. Nos. 493,464 and 568,687, polyamines such as diethylenetriamine and aminomethane sulphinic acid derivatives, e.g. according to Belgian Pat. No. 547,323, may also be used as chemical sensitizers.

Noble metals such as gold, platinum, palladium, iridium, ruthenium or rhodium and compounds of these metals are also suitable chemical sensitizers. This method of chemical sensitization has been described in the article by R. Koslowsky, Z. Wiss. Phot. 46, pages 65 to 72 (1951).

The emulsions may also be sensitized with polyalkyleneoxide derivatives, e.g. with a polyethylene oxide having a molecular weight of between 1,000 and 20,000, or with condensation products of alkylene oxides and aliphatic carboxylic acids, aliphatic amines, aliphatic diamines and amides. The condensation products have a molecular weight of at least 700, preferably more than 1,000. These sensitizers may, of course, be combined for producing special effects, as described in Belgian Pat. No. 537,278 and in British Pat. No. 727,982.

The emulsions may also be spectrally sensitized, e.g. with the usual monomethine or polymethine dyes, such as acid or basic cyanines, hemicyanines, streptocyanines, merocyanines, oxonoles, hemioxonoles, styryl dyes or others, as well as tri-nuclear or higher polynuclear methine dyes, for example rhodacyanines or neocyanines. Sensitizers of this kind have been described, for example, in the work by F. M. Hamer "The Cyanine Dyes and Related Compounds" (1964), Interscience Publishers, John Wiley and Sons.

The emulsions may contain the usual stabilizers, e.g. homopolar or salt compounds of mercury containing aromatic or heterocyclic rings, such as mercaptotriazoles, simple mercury salts, sulphonium-mercury double salts and other mercury compounds. Azaindenes are also suitable stabilizers, particularly tetra and pentaazaidenes and especially those which are substituted with hydroxyl or amino groups. Compounds of this type have been described in the article by Birr, Z. Wiss. Phot. 47, pages 2 to 58 (1952). Other stabilizers include, inter alia, heterocyclic mercapto compounds, e.g. phenylmercaptotetrazole, quaternary benzothiazole derivatives, and benzotriazole.

The emulsions may be hardened in the usual manner, for example with formaldehyde or halogen-substituted aldehydes which contain a carboxyl group, such as mucobromic acid, diketones, methanesulphonic acid esters and dialdehydes.

The photographic layers may also be hardened with epoxide type hardeners, heterocyclic ethylene imine hardeners or acryloyl hardeners. Examples of such hardeners have been described, for example, in German Offenlegungsschrift No. 2,263,602 and in British Pat. No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with diazine, triazine or 1,2-dihydroquinoline hardeners, as described in British Pat. Nos. 1,193,290; 1,251,091; 1,306,544 and 1,266,655 and in German Offenlegungsschrift No. 2,332,317.

Examples of such hardeners include diazine derivatives containing alkyl sulphonyl or arylsulphonyl groups and derivatives of hydrogenated diazines or triazines, e.g. 1,3,5-hexahydrotriazine, fluoro substituted diazine derivatives such as fluoropyrimidines, esters of 2-substituted 1,2-dihydroquinoline- or 1,2-dihydroisoquinoline-N-carboxylic acids. Vinyl sulphonic acid hardeners, carbodiimide hardeners and carbamoyl hardeners such as those described in German Offenlegungsschriften Nos. 2,263,602; 2,225,230 and 1,808,685; French Patent No. 1,491,807; German Federal Pat. No. 872,153 and East German Pat. No. 72 18 may also be used. Other suitable hardeners have been described, for example, in British Pat. No. 1,268,550.

The usual support layers are used. The following, for example, are suitable: foils of cellulose nitrate, cellulose acetate such as cellulose triacetate, polystyrene, polyesters such as polyethylene terephthalate, polyolefines such as polyethylene and polypropylene; a baryta-laminated or polyolefine laminated support, e.g. a polyethylene laminated paper support, as well as glass.

According to the invention, a conventional colour photographic material (negative or reversal material) is exposed imagewise and developed in the usual manner. After colour development, the developed silver image is oxidized in the bleaching bath and the photographic material is treated with an after-treatment bath containing one of the acids to be used according to the invention. The photographic material is then fixed and further treated in the usual manner. It may in some cases be advisable to carry out the treatment in the after-treatment bath, not between the bleaching process and the fixing process but after the fixing process.

The advantageous nature of the process according to the invention lies in the fact that it can be carried out with an uncomplicated, effective bleaching bath which is free from cyanides and that no reduction in the image quality occurs due to the action of this bath.

The bleaching baths containing bromide and iron-III salts may be regenerated in the usual manner, i.e. using a regenerator of such a composition that it both compensates for dilution of the bleaching bath and replaces the reduced iron-III salt and the bromide which has been used up by rehalogenation.

For large industrial consumers, there is the further advantage that contamination of the effluent is reduced if the regenerator contains only as much of iron-III salts as is necessary to compensate for dilution and if it contains the necessary bromide in the form of HBr. If air or oxygen is injected into the bleaching bath after the addition of such a regenerator, the iron-II ions formed in the bleaching process are reoxidized to iron-III ions without flocculation of insoluble iron hydroxide. The quantity of HBr which must be added for this regeneration is equivalent to the quantity of iron-II ions formed in the bleaching process. Conversely, if the quantity of bromide ions used up is replaced by adding bromide ions in the form of HBr and the bleaching bath is oxidized with atmospheric oxygen, the composition of the bleaching bath can be kept constant without excessive addition of atmospheric oxygen having any deleterious effects.

The advantages of the process according to the invention will be demonstrated in the following examples.

EXAMPLE 1

A commercial colour photographic multi-layered reversal material containing a red sensitive, a green sensitive and a blue sensitive silver halide emulsion layer in which the colour couplers for the yellow, magenta and cyan dye, dissolved in a high boiling solvent and emulsified in a finely divided form, are incorporated in the appropriate sensitized silver halide emulsion layers, is processed by the usual method after exposure.

The exposed colour photographic material is developed for 13 minutes in a developer of the following composition:

| Development bath 1 | g/l |
|---|---|
| Ethylenediaminotetracetic acid | 2.0 |
| Soda sicc. | 30 |
| Sodium sulphite sicc. | 50.0 |
| 1-phenyl-3-pyrazolidone | 0.3 |
| hydroquinone | 6.0 |
| potassium thiocyanate | 2.5 |
| potassium bromide | 2.0 |
| potassium iodide | 0.015 |

After a short stop bath, the photographic material is washed and subjected to a diffuse second exposure. It is then developed for a second time, this time for 6 minutes in a bath of the following composition:

| Development bath 2 | g/l |
|---|---|
| Ethylenediaminotetracetic acid | 2.0 |
| Trisodium phosphate sicc. | 60.0 |
| Sodium sulphite | 5.0 |
| 4-amino-3-methyl-N-ethyl-N-(β-hydroxyethyl)-anilinosulphate monohydrate | 6.0 |
| Potassium bromide | 2.0 |
| Ethylene diamine | 4.0 |

After another short stop bath and another washing, the photographic material is treated for 4 minutes in a bleaching bath of the following composition:

| Bleaching Bath | g/l |
|---|---|
| $FeCl_3 \cdot 6\ H_2O$ | 108 |
| KBr | 20 |

The photographic material is then treated with after-treatment baths A, B, C and D and finally fixed, washed and treated with a stabilizer bath. The treatment with after-treatment baths A and B corresponds to the known treatments in the art whereas treatment with after-treatment baths C and D represents the process according to the invention. The treatment in the after-treatment baths, the composition of which is indicated below, is carried out for 4 minutes in each case.

| After-treatment bath A | g/l |
|---|---|
| Tartraric acid | 10 |
| Potassium-sodium tartrate | 30 |
| pH: 3.8 | |
| **After-treatment bath B** | **g/l** |
| Citric acid | 30 |
| Sodium citrate | 20 |
| pH: 3.5 | |
| **After-treatment bath C** | **g/l** |
| 2-phosphonobutane-1,2,4-tri-carboxylic acid | 40 |
| pH: 1.6 | |
| **After-treatment bath D** | **g/l** |
| Phosphoric acid | 100 |
| pH: 1.0 | |

The sensitometric data for sensitivity, gradation and maximum density obtained after the treatment in baths A to D are virtually identical but the fogging values are substantially lower in the process according to the invention, as can be seen from the following table 1:

TABLE 1

| After-treatment bath | Fogging values for yellow | magenta | cyan |
|---|---|---|---|
| A | 0.39 | 0.36 | 0.17 |
| B | 0.32 | 0.30 | 0.15 |
| C | 0.23 | 0.21 | 0.13 |
| D | 0.21 | 0.20 | 0.13 |

The advantages of the process according to the invention are obvious from a comparison of the results obtained with after-treatment baths A and B on the one hand and C and D on the other.

EXAMPLE 2

The photographic material described in Example 1 is exposed and processed as indicated in Example 1 except that instead of after-treatment baths A to D, the after-treatment baths E, F, G and H having the composition indicated below are used.

| After-treatment bath E | g/l |
|---|---|
| Citric acid<br>ph: 1.9 | 50 |
| **After-treatment bath F** | **g/l** |
| Tartaric acid<br>pH: 1.8 | 50 |
| **After-treatment bath G** | **g/l** |
| 1-phosphono-succinic acid<br>pH: 1.1 | 40 |
| **After-treatment bath H** | **g/l** |
| 2,4-di-phosphonobutane-1,2-dicarboxylic acid<br>pH: 1.3 | 40 |

The fogging values obtained after the treatment in after-treatment baths E to H are shown in Table 2 below:

TABLE 2

| After-treatment bath | Fogging values for yellow | magenta | cyan |
|---|---|---|---|
| E | 0.41 | 0.41 | 0.16 |
| F | 0.42 | 0.42 | 0.16 |
| G | 0.16 | 0.15 | 0.11 |

TABLE 2-continued

| After-treatment bath | Fogging values for yellow | magenta | cyan |
|---|---|---|---|
| H | 0.21 | 0.20 | 0.12 |

The fogging values obtained with the treatment according to the invention using after-treatment baths G and H are substantially lower than those obtained from the treatment with after-treatment baths E and F which are known in the art.

We claim:

1. A process for producing color photographic images by imagewise exposure of a color photographic material containing at least one silver halide emulsion layer, color development, bleaching, after-treatment with an acid compound capable of discoloration prevention, in a bath and fixing, wherein the improvement comprises the photographic material is first treated with a bleaching bath containing an iron III salt and then is treated with a bath which contains an effective amount of an acid discoloration preventative compound corresponding to the following general formula:

$$A—PO_3H_2$$

wherein A denotes hydroxyl or an alkyl group having from 1 to 6 C atoms which is substituted with at least one carboxyl group.

2. A process according to claim 1, characterised in that A is in addition substituted with at least one $PO_3H_2$, $SO_3H$, OH or polyalkylene group.

3. A process according to claim 1, characterised in that the acid is contained in the after-treatment bath in a quantity of from 50 to 150 g/l.

4. A process according to claim 1, characterised in that the compound of the general formula $$A—PO_3H_2$$

is 2-phosphonobutane-1,2,4-tricarboxylic acid.

5. A process according to claim 1, characterised in that the iron salt is iron-III chloride and/or iron-III sulphate.

6. A process according to claim 1, characterised in that the bleaching bath contains an alkali metal bromide and/or ammonium bromide in a quantity of from 10 to 50 g/l in addition to the iron-III salt.

* * * * *